United States Patent [19]

Anderson

[11] 4,130,334

[45] Dec. 19, 1978

[54] GROUND TERMINATION AND STRAIN RELIEF CONNECTOR MEANS

[75] Inventor: Brent W. Anderson, Aloha, Oreg.

[73] Assignee: Tektronix, Inc., Beaverton, Oreg.

[21] Appl. No.: 839,144

[22] Filed: Oct. 3, 1977

[51] Int. Cl.[2] ..... H01R 13/58

[52] U.S. Cl. ..... 339/103 M; 174/78; 339/14 R

[58] Field of Search ..... 339/103 M, 103 C, 104, 339/14; 174/78, 135, 65 R

[56] References Cited

U.S. PATENT DOCUMENTS

| | | | |
|---|---|---|---|
| 3,795,885 | 3/1974 | Desso et al. | 339/103 M X |
| 3,854,787 | 12/1974 | Snyder, Jr. | 339/103 R |
| 3,871,733 | 3/1975 | Praeger et al. | 339/103 M X |

*Primary Examiner*—Roy Lake
*Assistant Examiner*—DeWalden W. Jones
*Attorney, Agent, or Firm*—Adrian J. La Rue

[57] ABSTRACT

A ground termination and strain relief connector means includes a termination plate to which an exposed section of a shield conductor means of a flat cable means is connected. The termination plate with the shield conductor means secured thereto is clamped onto an instrument housing to form the ground connection and also provide a strain relief for the cable means.

8 Claims, 7 Drawing Figures

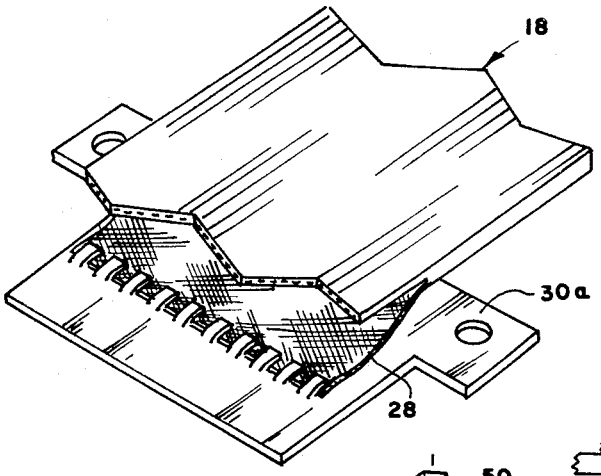
Fig-4
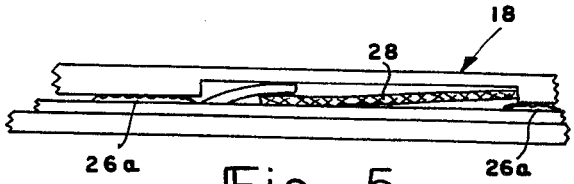
Fig-5
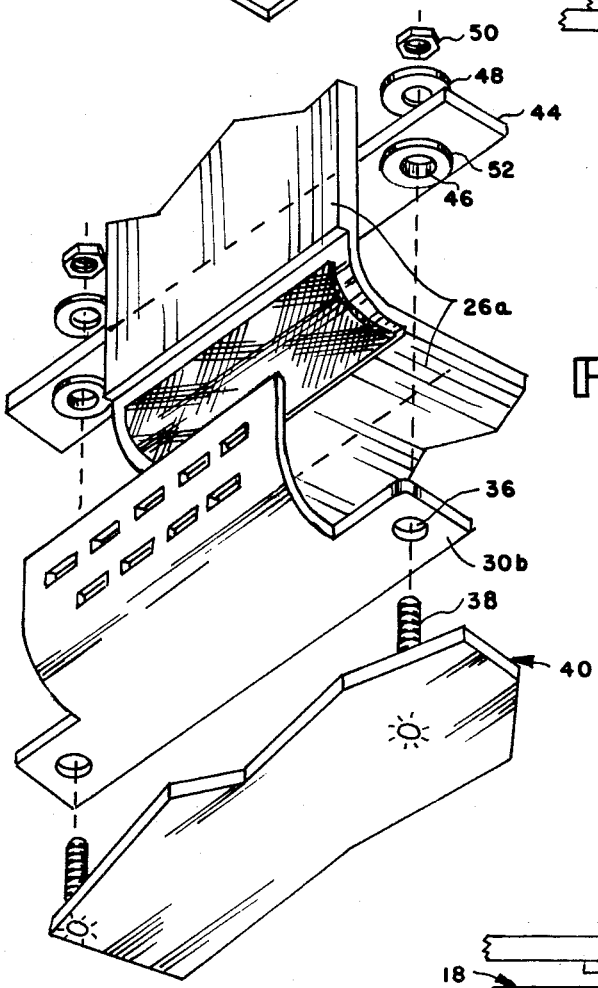
Fig-7
Fig-6
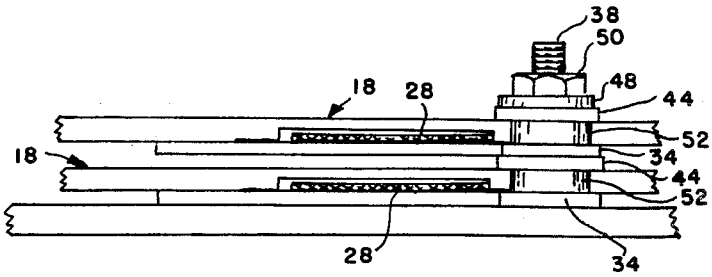

GROUND TERMINATION AND STRAIN RELIEF CONNECTOR MEANS

BACKGROUND OF THE INVENTION

In microprocessor design assist instrumentation, a prototype control probe is connected via a flat cable to a controller which in turn is also connected to a memory also by means of a flat cable. These flat cables contain a shielding conductor within the insulation but isolated from the parallel conductors which are also isolated from each other.

If the shielding conductor, also known as the ground plane, is not properly terminated, the flat cable is susceptible to static discharge which can interrupt the signals being transmitted along the conductors as well as destroying information that is stored in a memory.

SUMMARY OF THE INVENTION

This invention relates to conductor terminations and more particularly to terminations for ground conductor means of flat cable means and strain relief means therefor.

The invention is realized by exposing a section of a ground conductor means of a flat cable means, electrically connecting the exposed section of the ground conductor means to a termination plate and clamping the termination plate with the flat cable secured thereto onto an instrument housing thereby connecting the ground conductor means thereto via the termination plate and providing strain relief for the flat cable means.

An object of the present invention is to provide a reliable low impedance electrical termination connector means of cable ground conductor means to an instrument housing.

A further object of the present invention is the provision of electrical termination connector means for flat cable ground conductor means and strain relief means therefor.

An additional object of the present invention is to provide ground termination and strain relief connector means for ground conductor means of flat cable means which are able to be stacked one upon another for conserving space when multiple terminations are required.

A still further object of the present invention is the provision of ground termination and strain relief connector means for flat cable means that allows termination of the ground conductor means at any location along the flat cable means, provides protection for the fragile ground conductor means during cable handling and installation, allows for quick connection and disconnection of cable means and provides protection against static discharge of very high voltages.

The foregoing and other objects and advantages of the present invention will become apparent from the following detailed description of preferred embodiments thereof and from the attached drawings.

BRIEF DESCRIPTION OF THE DRAWINGS

FIG. 4 is a perspective view with part of the flat cable means broken away showing an alternative embodiment of the termination plate;

FIG. 5 is a part side elevational view showing the termination plate of FIG. 4 terminated to a ground conductor means of a flat cable means;

FIG. 6 shows a stacked assembly of ground termination and strain relief connector means and their respective flat cable means; and FIG. 7 shows another embodiment constituting a perspective exploded view of a curved termination plate and the cable means.

DETAILED DESCRIPTION OF THE INVENTION

Figure 1:
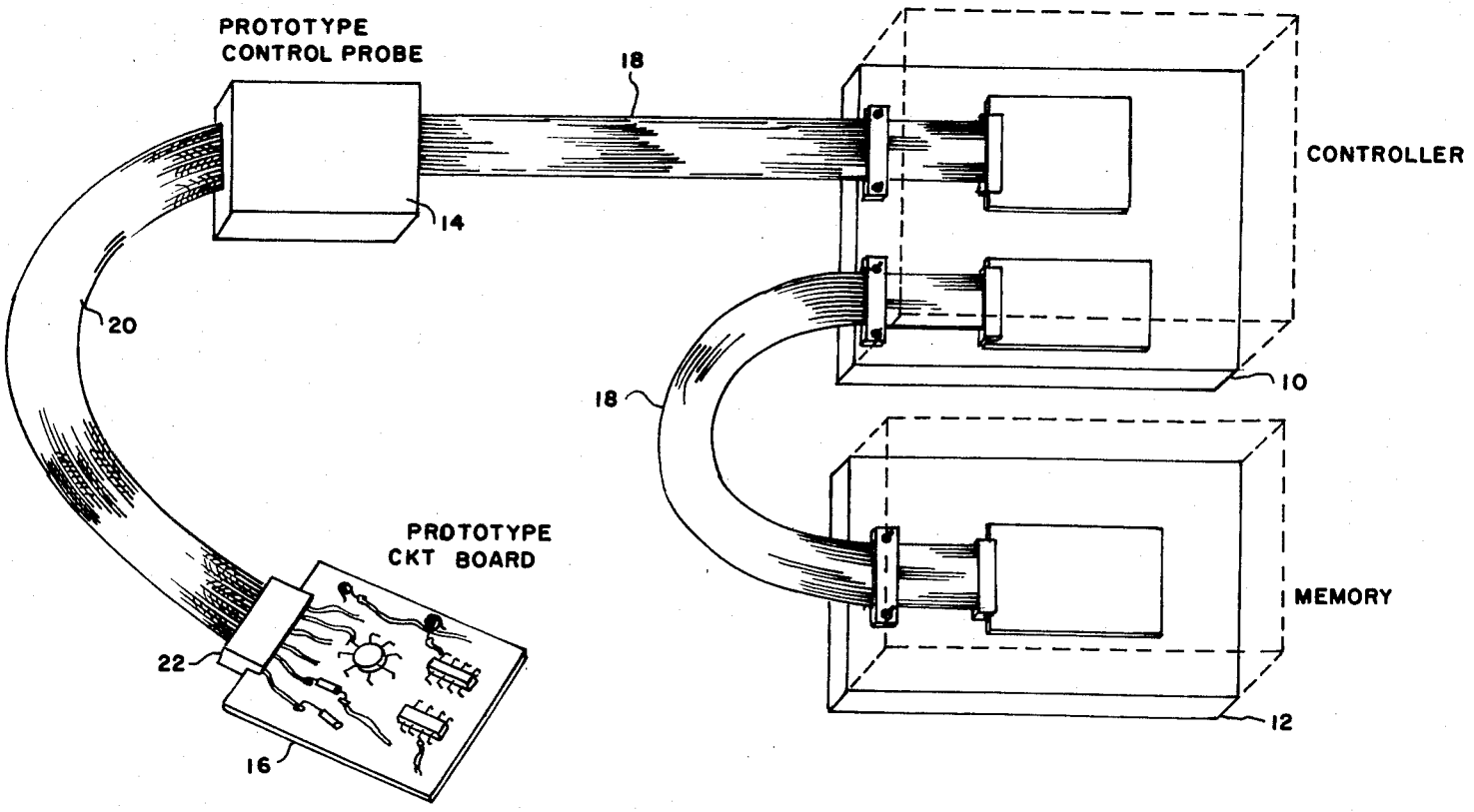
FIG. 1 is a block diagram showing a microprocessor design assist system utilizing the present invention.

Turning now to the drawings, a microprocessor design assist system is illustrated in FIG. 1 which includes a controller 10, a memory 12, a prototype control probe 14 and a prototype circuit board 16. Flat cable means 18 connects memory 12 and prototype control probe 14 with controller 10 via connector means (not shown). Woven cable means 20 and connector 22 connect the prototype control probe 14 to prototype circuit board 16. With this arrangement, a circuit in its prototype stage on prototype circuit board 16 using selected microprocessor semiconductor means can be emulated to determine its operational characteristics before it is finalized.

Flat cable means 18 contains a plurality of signal carrying conductors 24 within a covering of insulating material 26 which is generally polyvinyl chloride. Conductors 24 extend parallel along insulating material 26 and they are isolated from each other via the insulation as well as being isolated from a shielding conductor 28 which extends along the length of the flat cable means adjacent to conductors 24. Conductors 24 are generally made from copper wires whereas shielding conductor 28 is made from copper mesh or chemically-milled metal, but it can be made of continuous metal film.

In order to prevent interruption of the microprocessor design assist system because of high static discharge voltages, it is important to properly electrically terminate the shielding conductor 28 of flat cable means 18 to ground which then becomes the ground plane. In this manner, the system will be protected from such high static discharge voltages.

Figure 2:
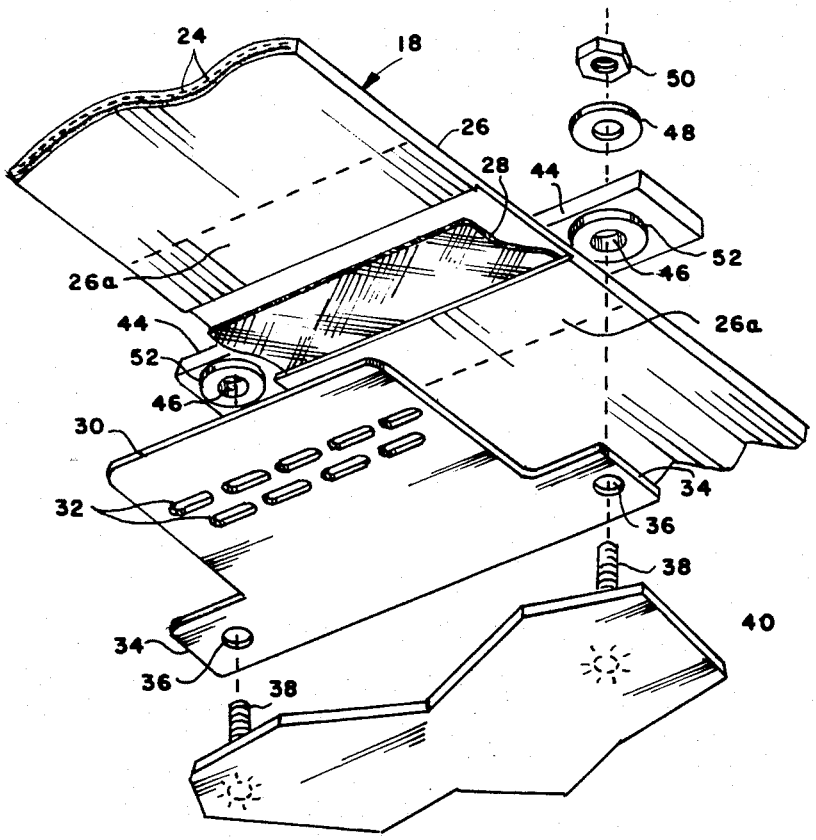
FIG. 2 is a perspective exploded view with parts broken away of the ground termination and strain relief connector means and flat cable means with a section of the ground conductor means exposed.
Figure 3:
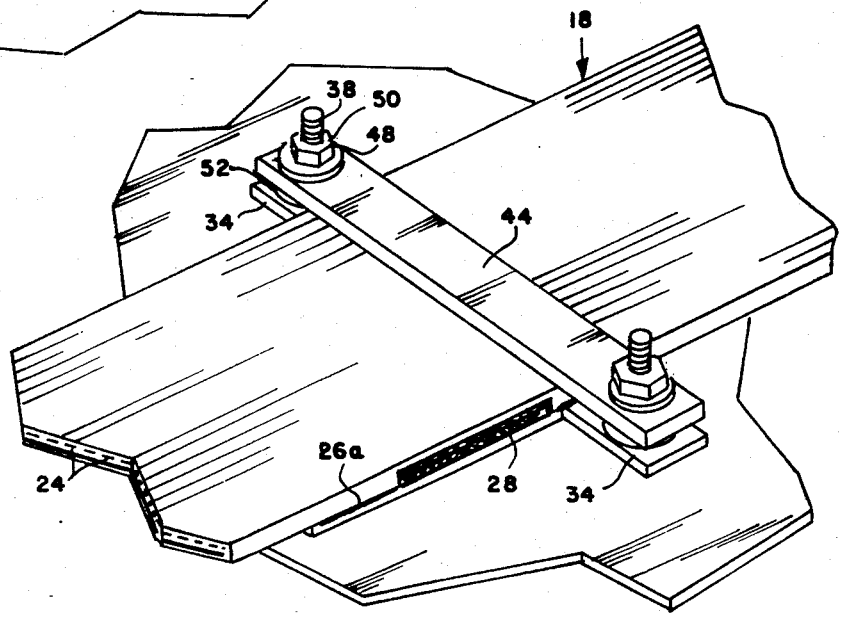
FIG. 3 is a perspective view similar to FIG. 2 showing the ground termination and strain relief connector means in position on the instrument housing.

In order to properly terminate the shielding conductor 28 to ground, a ground termination and strain relief connector means is provided as best illustrated in FIGS. 2 and 3. A metal termination plate 30 is provided with two rows of offset oblong holes 32 and projections 34 which have holes 36 therethrough. Termination plate 30 has a width about the same as flat cable means 18 and mounting projections 34 termination plate 30 to be mounted on threaded members 38 extending outwardly from metal housing 40 via holes 36.

A section of flat cable means 18 is selected and it is passed across an abrasive grinding wheel of a flat cable stripper which is completely disclosed in U.S. Pat. No. 3,385,140. Several passes of the flat cable means across the grinding wheel grinds away the insulation thereby bearing a desired length of shielding conductor 28. The insulation can be removed in other ways such as by a stripping tool that uses a sharp blade to cut the insulation to a predetermined depth at several locations and the insulation is stripped off to bear a section of the conductor. One end of conductor 28 is cut free and it is positioned adjacent one row of holes 32 while overlying the other row. Conductor 28 is then soldered to plate 30. Holes 32 provide alignment and minimize heat loss.

A high strength vinyl adhesive 26a, which is identified as 3M Type 2262 and manufactured by Minnesota Mining and Manufacturing Co., is applied on to termination plate 30 and the polyvinyl chloride insulation 26 of the flat cable means adjacent each side of the exposed section and these sections of the flat cable means are bonded to termination plate 30. The vinyl adhesive bonds quickly.

With the cable means bonded to termination plate 30, this arrangement protects the electrical connection between conductor 28 and plate 30 and provides protection for the thin conductor 28 during cable handling and installation on housing 40.

An alternative embodiment of termination plate **30*a* is shown by FIGS. 4 and 5 which has the same general configuration as that of termination plate 30 except that a row of tynes 42 are stamped and formed from plate 30. The end of the exposed section of conductor 28 is placed against the inner ends of tynes 42 which are anchored to plate 30 and tynes 42 are controllably crimped onto engagement with conductor 28 in such a manner that the conductor is not damaged and an excellent mechanical and electrical connection is effected. Moreover, the crimping of tynes 42 into engagement with conductor 28 will break through any oxide coating on the tynes 42 and the conductor thereby resulting in an excellent electrical connection. After the tynes 42 have been crimped onto engagement with conductor 28, the insulation 26 of the cable means on each side of the exposed section is bonded to plate 30*a* as described above to protect the electrical connection between tynes 42 and conductor 28 and to protect the then conductor 28** when the cable means is handled or installed.

The termination plate 30 or **30*a* with the conductor 28 terminated thereto and the insulation also bonded thereto is positioned onto threaded members 38 of housing 40 and a clamping bar 44 having holes 46 for matable engagement with members 38 is positioned thereon. Washers 48 are then placed on members 38 and nuts 50 are threadably mounted on members 38 so that bar 44 is clampingly secured in position against cable means 18. Spacers 52 surrounding holes 46 are provided by clamping bar 44 to enable the clamping bar to apply the proper amount of clamping pressure to cable means 18 so that a proper ground connection is effected between termination plate 30 and housing 40 and no cold flowing of the cable insulation 26 takes place which could result in minimal insulation covering the conductors 24 in this area that could affect their operation or exposed conductors which could cause them to short. Spacers 52 also minimize bowing of clamping bar 44 so that stacking of other cable means 18*a*, 18*b* with their respective termination plates terminated and secured thereto can readily be done as illustrated by FIG. 6** when necessary.

Termination plate 30 or **30*a* can be curved to enable them with the cable means terminated and secured thereto as shown in FIG. 7** to be mounted within an instrument housing where space requirements are a problem.

As can be discerned, a unique ground termination and strain relief connector means has been disclosed for terminating the ground plane of a flat cable means and for providing strain relief when the connector means is clamped onto or within an instrument housing. While preferred embodiments of the present invention have been illustrated and described, it will be apparent that changes and modificaions may be made to this invention without departing from its broad aspects. The appended claims cover all such changes and modifications as fall therewithin.

The invention is claimed in accordance with the following:

1. A ground termination and strain relief connector means for use in connection with flat cable means having a plurality of signal conductor means covered by insulation means and isolated from each other thereby and shielding conductor means extending along the signal conductor means and isolated therefrom by the insulation means but covered thereby, said connector means comprising:

termination plate means having a termination area for positioning an exposed section of the shielding conductor means and means provided along said termination area for connecting the exposed section of the shielding conductor means to said termination plate means;

mounting means provided by said termination plate means for mounting said termination plate means and the flat cable means with the shielding conductor means connected thereto onto connector mounting means of an instrument; and clamping means for engagement with the connector mounting means for clamping said termination plate means and flat cable means thereon onto the instrument thereby forming a ground connection of the shielding conductor means with the instrument and to provide strain relief for the flat cable means.

2. A ground termination and strain relief connector means according to claim 1 wherein said termination area includes rows of offset holes with one row acting as an alignment for aligning an end of the exposed section of the shielding conductor means and the connecting means comprises solder.

3. A ground termination and strain relief connector means according to claim 1 wherein said connecting means comprises a row of stamped and formed tyne means which are crimpable into engagement with the shielding conductor means.

4. A ground termination and strain releif connector means according to claim 1 wherein said clamping means comprises bar means having spacer means which minimizes bowing of said bar means so that proper clamping pressure is applied to the insulation means without cold flowing thereof.

5. A method of forming a ground termination of a shielding conductor of flat cable means and strain releif therefor comprising:

removing insulation from a section of the flat cable means thereby exposing a section of the shielding conductor;

connecting said section of the shielding conductor to a termination plate;

mounting the termination plate with the shielding conductor connected thereto to a housing member; and clamping the termination plate and flat cable means onto the housing member to form a ground termination therewith and to provide a strain relief for said flat cable means.

6. A method according to claim 5 wherein the step of connecting the section of the shielding conductor to the termination plate comprises soldering.

7. A method according to claim 5 wherein the step of connecting the section of the shielding conductor to the termination plate comprises crimping.

8. A method according to claim 5 which comprises the further step of bonding the insulation of the flat cable means on each side of the exposed section of the shielding conductor to the termination plate.

* * * * *

UNITED STATES PATENT AND TRADEMARK OFFICE

CERTIFICATE OF CORRECTION

PATENT NO. : 4,130,334

DATED : December 19, 1978

INVENTOR(S) : BRENT W. ANDERSON

It is certified that error appears in the above-identified patent and that said Letters Patent are hereby corrected as shown below:

Column 2, Line 54, change "34 termination" to --34 enable termination--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*